US010816000B2

(12) United States Patent
Kim et al.

(10) Patent No.: US 10,816,000 B2
(45) Date of Patent: Oct. 27, 2020

(54) COMPRESSOR HAVING CENTRIFUGATION STRUCTURE FOR SUPPLYING OIL

(71) Applicant: LG ELECTRONICS INC., Seoul (KR)

(72) Inventors: Cheol Hwan Kim, Seoul (KR); Kangwook Lee, Seoul (KR); Byeongchul Lee, Seoul (KR); Yong Kyu Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 209 days.

(21) Appl. No.: 15/830,290

(22) Filed: Dec. 4, 2017

(65) Prior Publication Data

US 2019/0024664 A1 Jan. 24, 2019

(30) Foreign Application Priority Data

Jul. 24, 2017 (KR) ..... 10-2017-0093677

(51) Int. Cl.
*F01C 1/02* (2006.01)
*F03C 2/00* (2006.01)
(Continued)

(52) U.S. Cl.
CPC ..... *F04C 29/025* (2013.01); *F04C 18/0215* (2013.01); *F04C 23/008* (2013.01);
(Continued)

(58) Field of Classification Search
CPC ..... F04C 18/0215; F04C 18/0246; F04C 18/0261; F04C 18/0292; F04C 23/008;
(Continued)

(56) References Cited

U.S. PATENT DOCUMENTS 4,596,520 A 6/1986 Arata et al.
4,626,180 A * 12/1986 Tagawa ..... F04C 29/025 418/63
(Continued)

FOREIGN PATENT DOCUMENTS

EP 1 526 283 4/2005
EP 2 369 182 9/2011
(Continued)

OTHER PUBLICATIONS

European Search Report dated Apr. 26, 2018 issued in Application No. 17199214.2.
(Continued)

*Primary Examiner* — Theresa Trieu
(74) *Attorney, Agent, or Firm* — KED & Associates LLP

(57) ABSTRACT

A scroll compressor is provided which is capable of supplying oil stored in an oil storage chamber upward through a rotary shaft to lubricate a bearing portion. The scroll compressor may include a casing in which oil is stored in an oil storage chamber formed at a lower portion of the casing, a drive motor provided in an inner space of the casing, a rotary shaft coupled to the drive motor and including an oil supply path configured to guide the oil stored in the oil storage chamber and at least one oil hole that passes from the oil supply path to an outer circumferential surface of the rotary shall a main frame coupled to the rotary shaft and provided under the drive motor, a fixed scroll coupled to the rotary shaft and provided under the main frame, and an orbiting scroll provided between the main frame and the fixed scroll, into which the rotary shaft is inserted and to which the rotary shaft is eccentrically coupled, the orbiting scroll performing an orbiting movement to form a compression chamber with the fixed scroll. The oil guided upward through the oil supply path may be discharged through the
(Continued)

at least one oil hole and supplied to the outer circumferential surface of the rotary shaft.

6 Claims, 5 Drawing Sheets

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 29/02*** | (2006.01) |
| ***F04C 18/02*** | (2006.01) |
| ***F04C 29/00*** | (2006.01) |
| ***F04C 23/00*** | (2006.01) |

(52) U.S. Cl.
CPC ..... *F04C 29/0057* (2013.01); *F04C 29/023* (2013.01); *F04C 2240/30* (2013.01); *F04C 2240/50* (2013.01); *F04C 2240/60* (2013.01)

(58) Field of Classification Search
CPC .. F04C 27/005; F04C 29/023; F04C 2210/26; F04C 2240/30; F04C 2240/60; F04C 2240/603
USPC ..... 418/88, 94, 55.1–55.6, 57; 184/6.16–6.18
See application file for complete search history.

(56) References Cited

U.S. PATENT DOCUMENTS

| | | | | |
|---|---|---|---|---|
| 4,768,936 | A * | 9/1988 | Etemad | F04C 18/0215 418/55.6 |
| 4,898,521 | A * | 2/1990 | Sakurai | F04C 18/0215 418/55.6 |
| 5,803,722 | A | 9/1998 | Noboru | |
| 6,273,691 | B1 | 8/2001 | Morimoto et al. | |
| 2009/0098000 | A1 | 4/2009 | Ignatiev | |
| 2010/0122549 | A1* | 5/2010 | Cho | F04C 18/0215 418/55.6 |
| 2012/0148434 | A1 | 6/2012 | Takabe et al. | |
| 2013/0078131 | A1 | 3/2013 | Ahn et al. | |
| 2013/0343941 | A1 | 12/2013 | Kim et al. | |
| 2014/0234148 | A1 | 8/2014 | Takeda | |
| 2016/0040671 | A1 | 2/2016 | Choi et al. | |
| 2016/0040673 | A1 | 2/2016 | Lee et al. | |
| 2016/0047378 | A1 | 2/2016 | Choi et al. | |
| 2016/0053759 | A1 | 2/2016 | Choi et al. | |
| 2016/0108917 | A1* | 4/2016 | Bonnefoi | F04C 18/0215 418/55.6 |
| 2016/0341249 | A1* | 11/2016 | Yang | F16C 33/1095 418/178 |

FOREIGN PATENT DOCUMENTS

| | | |
|---|---|---|
| EP | 2 574 791 | 4/2013 |
| EP | 2 690 287 | 1/2014 |
| JP | S 62-178791 | 8/1987 |
| JP | H 03-202682 | 9/1991 |
| JP | H 07-054784 | 2/1995 |
| JP | H 08-303364 | 11/1996 |
| JP | H 08-303365 | 11/1996 |
| JP | H 10-169574 | 6/1998 |
| JP | 2009-036069 | 2/2009 |
| JP | 2010-180704 | 8/2010 |
| JP | 5 199951 | 5/2013 |
| KR | 10-1059880 | 8/2011 |
| KR | 10-2013-0034536 | 4/2013 |
| KR | 10-2016-0017539 | 2/2016 |
| WO | WO 97/17543 | 5/1997 |
| WO | WO 2014/198215 | 12/2014 |
| WO | WO 2015/085823 | 6/2015 |

OTHER PUBLICATIONS

Korean Office Action dated Aug. 20, 2018.
European Search Report dated Sep. 7, 2018.
European Search Report dated May 4, 2018 issued in Application No. 17204354.9.
European Search Report dated May 17, 2018 issued in Application No. 17205582.4.
Korean Office Action dated Jul. 16, 2018 issued in Application No. 10-2017-0075041.
United States Office Action dated Oct. 31, 2019 issued in co-pending related U.S. Appl. No. 15/830,161.
United States Office Action dated Jan. 14, 2020 issued in co-pending related U.S. Appl. No. 15/830,135.
U.S. Appl. No. 15/830,248, filed Dec. 4, 2017.
European Office Action dated Feb. 6, 2020.
U.S. Office Action dated Jan. 28, 2020 issued in co-pending related U.S. Appl. No. 15/830,222.
U.S. Appl. No. 15/830,135, filed Dec. 4, 2017.
U.S. Appl. No. 16/692,112, filed Nov. 22, 2019.
U.S. Appl. No. 15/830,161, filed Dec. 4, 2017.
U.S. Appl. No. 15/830,184, filed Dec. 4, 2017.
U.S. Appl. No. 15/830,222, filed Dec. 4, 2017.
U.S. Appl. No. 16/692,088, filed Nov. 22, 2019.
U.S. Appl. No. 15/830,290, filed Dec. 4, 2017.
U.S. Notice of Allowance issued in U.S. Appl. No. 15/830,222 dated Jun. 18, 2020.

* cited by examiner

COMPRESSOR HAVING CENTRIFUGATION STRUCTURE FOR SUPPLYING OIL

CROSS-REFERENCE TO RELATED APPLICATION(S)

This application claims priority to and the benefit of Korean Patent Application No. 10-2017-0093677, filed in Korea on Jul. 24, 2017, the disclosure of which is incorporated herein by reference in its entirety.

BACKGROUND

1. Field

A compressor having a centrifugation structure for supplying oil is disclosed herein.

2. Background

Generally, a compressor is applied to a vapor compression type refrigeration cycle (hereinafter, referred to as a "refrigeration cycle") used for a refrigerator, or an air conditioner, for example. (Compressors may be classified into reciprocating compressors, rotary compressors, and scroll compressors, for example, according to a method of compressing a refrigerant.

The scroll compressor among the above-described compressors is a compressor which performs an orbiting movement by engaging an orbiting scroll with a fixed scroll fixed inside of a seated container so that a compression chamber is formed between a fixed wrap of the fixed scroll and an orbiting wrap of the orbiting scroll. The scroll compressor is widely used for compressing a refrigerant in an air conditioner, for example, because the scroll compressor can obtain a relatively higher compression ratio than the other types of compressors and can obtain a stable torque because suction, compression, and discharge strokes of the refrigerant are smooth and continuous.

Such scroll compressors may be classified into upper compression type compressors or lower compression type compressors according to a location of a drive motor and a compression component. The compression component is located at a higher level than the drive motor in the upper compression type compressor, and the compression component is located at a lower level than the drive motor in the lower compression type compressor.

As there is a short distance between an oil storage chamber and the compression device in the lower compression type scroll compressor, oil may be relatively uniformly supplied thereto; however, it may be structurally difficult to supply the oil thereto. More particularly, in the lower compression type scroll compressor which is driven at various speeds from low to high speed, it is important to optimize performance and secure reliability of a bearing portion according to a flow rate of oil. Accordingly, a structural improvement for supplying oil is required for portions, such as a bearing surface, that is, an outer circumferential surface of a bearing portion, to which it is structurally difficult to supply oil.

BRIEF DESCRIPTION Of THE DRAWINGS

Embodiments will be described in detail with reference to the following drawings in which like reference numerals refer to like elements, and wherein.

DETAILED DESCRIPTION

Figure 1:
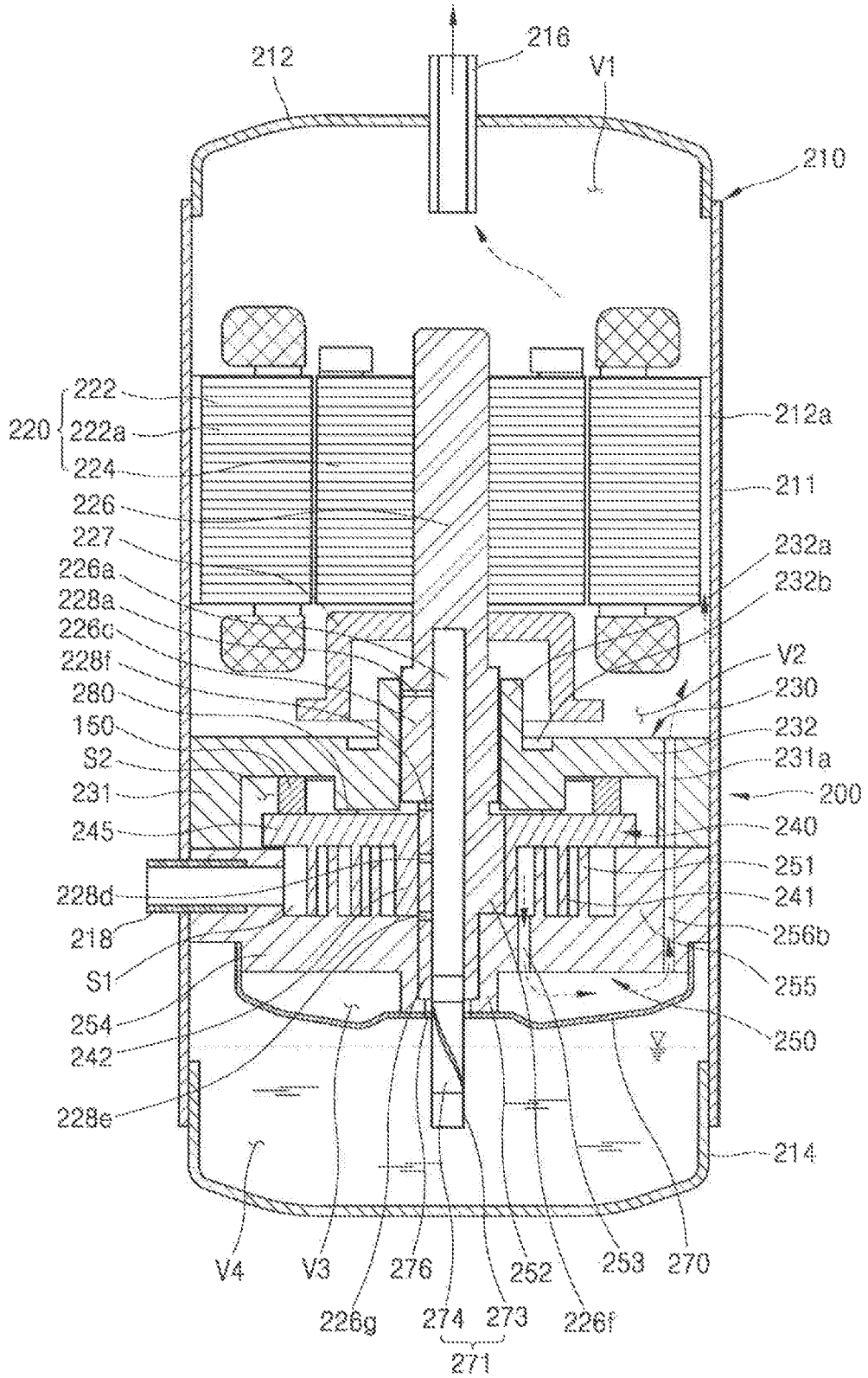
FIG. 1 is a cross-sectional of a scroll compressor according to an embodiment.

Hereinafter, embodiments will be described with reference to accompanying drawings. Where possible, like or similar reference numerals in the drawings have been used to indicate like or similar elements, and repetitive disclosure has bean omitted.

Hereinafter, a scroll compressor according to an embodiment will be described with reference to FIG. 1.

FIG. 1 is a cross-sectional view of a scroll compressor according to an embodiment. The scroll compressor according to an embodiment may include a casing 210 having an inner space, a drive motor 220 provided in an upper portion of the inner space, a compression part or device 200 disposed under the drive motor 220, and a rotary shaft 226 configured to transmit a drive force of the drive motor 220 to the compression device 200.

The inner space of the casing 210 may be divided into a first space V1, which may be provided at an upper side of the drive motor 220, a second space V2 between the drive motor 220 and the compression device 200, a third space V3 partitioned by a discharge cover 278, and an oil storage chamber V4, which may be provided under the compression device 200.

The casing 210, for example, may have a cylindrical shape, and thus, the casing 210 may include a cylindrical shell 211. Art upper shell or cover 212 may be installed or provided on or at an upper portion of the cylindrical shell 211, and a lower shell or cover 214 may be installed or provided on or at a lower portion of the cylindrical shell 211. The upper and lower shells 212 and 214 may be coupled to the cylindrical shell 211 by welding, for example, and may form the inner space thereof.

A refrigerant discharge pipe 216 may be installed or provided in the upper shell 212. The refrigerant discharge pipe 216 may form a path through which a compressed refrigerant discharged from the compression device 200 into the second space V2 and the first space V1 may be discharged to the outside. An oil separator (not shown) configured to separate oil mixed with the discharged refrigerant may be connected to the refrigerant discharge pipe 218.

The lower shell 214 may form the oil storage chamber V4 capable of storing oil therein. The oil storage chamber V4 may serve as an oil chamber from which the oil may be supplied to the compression device 200 so that the compressor may be smoothly operated.

A refrigerant suction pipe 218, which may form a path through which a refrigerant to be compressed may be introduced, may be installed or provided in or at a side surface of the cylindrical shell 211. The refrigerant suction pipe 218 may be installed or provided to penetrate up to a compression chamber S1 along a side surface of a fixed scroll 250.

The drive motor 220 may be installed or provided in or at an upper portion inside of the casing 210. The drive motor 220 may include a stator 222 and a rotor 224.

The stator 222, for example, may have a cylindrical shape, and may be fixed to the casing 210. A plurality of slots (not shown) may be formed in an inner circumferential surface of the stator 222 in a circumferential direction, and a coil 222*a* may be wound on the stator 222. A refrigerant flow groove 212*a* may foe out in a D-cut shape and may be formed in an outer circumferential surface of the stator 222 so that a refrigerant or oil discharged from the compression device 200 may pass through the refrigerant flow groove 212*a*.

The rotor 224 may be coupled to an inside of the stator 222 and may generate rotational power. Also, the rotary shaft 226 may be press-fitted into a center of the rotor 224 so that the rotary shaft 226 may rotate with the rotor 224. The rotational power generated by the power rotor 224 may be transmitted to the compression device 200 through the rotary shaft 226.

The compression device 200 may include a main frame 230, the fixed scroll 250, an orbiting scroll 240, and the discharge cover 270. The compression device 200 may further include an Oldham's ring 150. The Oldham's ring 150 may be installed or provided between the orbiting scroll 240 and the main frame 230. The Oldham's ring 150 may prevent rotation of the orbiting scroll 240 and allow orbiting movement of the orbiting scroll 240 on the fixed scroll 250.

The main frame 230 may be provided under the drive motor 220 and may form an upper portion of the compression device 200. The main frame 230 may include a frame end plate (hereinafter, a "first end plate") 232 having a circular shape, a frame bearing section (hereinafter, a "first bearing section") 232*a*, which may be provided at a center of the first end plate 232 and through which the rotary shaft 226 may pass, and a frame sidewall (hereinafter, a "first sidewall") 231, which may protrude downward from an outer circumferential portion of the first end plate 232. An cuter circumferential portion of the first sidewall 231 may be in contact with an inner circumferential surface of the cylindrical shell 211, and a lower end of the first sidewall 231 may be in contact with an upper end of a fixed scroll sidewall 256.

The first sidewall 231 may include a frame discharge hole (hereinafter, a "first discharge hole") 231*a*, which may pass through an inside of the first sidewall 231 in an axial direction and form a refrigerant path. An inlet of the first discharge hole 231*a* may communicate with an outlet of a fixed scroll discharge hole 256*b*, which will be described hereinafter, and an outlet of the first discharge hole 231*a* may communicate with the second space V2.

The first bearing section 232*a* may protrude from an upper surface of the first end plate 232 toward the drive motor 220. A first bearing portion may be formed at the first bearing section 232*a* so that a main bearing portion 226*c* of the rotary shaft 226, which will be described hereinafter, may pass therethrough and be supported by the first hearing portion. That is, the first bearing section 232*a*, into which the main hearing portion 226*c*, which forms the first bearing portion, of the rotary shaft 226 is rotatably inserted and by which the main bearing portion 226*c* is supported by the first bearing section 232*a*, may be formed at a center of the main frame 230 in the axial direction.

An oil pocket 232*b* configured to collect oil discharged from between the first bearing section 232*a* and the rotary shaft 228 may be formed in an upper surface of the first end plate 232. The oil pocket 232*b* may be formed by carving the upper surface of the first end plate 232 and may be formed in a circular shape along an outer circumferential surface of the first bearing section 232*a*. In addition, a back pressure chamber S2 may be formed in a lower surface of the main frame 230 to form a space with the fixed scroll 250 and the orbiting scroll 240 to support the orbiting scroll 240 using a pressure of the space.

The back pressure chamber S2 may include a medium pressure region, that is, a medium pressure chamber, and an oil supply path 226*a* provided in the rotary shalt 226 may include a high pressure region having a higher pressure than the back pressure chamber S2. A back pressure seal 280 may be provided between the main frame 230 and the orbiting scroll 240 to divide the high pressure region from the medium pressure region, and the back pressure seal 280 may serve as a sealing member.

In addition, the main frame 230 may be coupled to the fixed scroll 250 to form a space in which the orbiting scroll 240 may be rotatably installed or provided. That is, such a structure may be a structure which covers the rotary shaft 226 to transmit rotational power to the compression device 200 through the rotary shaft 226.

The fixed scroll 250 forming a first scroll may be coupled to a lower surface of the main frame 230. More specifically, the fixed scroll 250 may be provided below the main frame 230.

The fixed scroll 250 may include a fixed scroll end plate (a "second end plate") 254 having a substantially circular shape, a fixed scroll sidewall (hereinafter, a "second sidewall") 255 that protrudes upward from an outer circumferential portion of the second end plate 254, a fixed wrap 251 that protrudes from an upper surface of the second end plate 254 and is engaged with an orbiting wrap 241 of the orbiting scroll 240, which will be described hereinafter, to form the compression chamber S1, and a fixed scroll bearing section (hereinafter, a "second bearing section") 252 formed at a confer of a rear surface of the second end plate 254 and through which the rotary shaft 226 may pass.

A discharge hole 251 configured to guide a compressed refrigerant from the compression chamber S1 to an inner space of the discharge cover 270 may be formed in the second end plate 254. In addition, a position of the discharge hole 253 may be arbitrarily determined in consideration of a required discharging pressure, for example.

As the discharge hole 253 is formed to face the lower shell 214, the discharge cover 270 for accommodating a discharged refrigerant and guiding the discharged refrigerant to the fixed scroll discharge hole 256*b*, which will be described hereinafter, in a state in which the discharged refrigerant is not mixed with oil, may be coupled to a lower surface of the fixed scroll 250. The discharge cover 270 may be hermetically coupled to a lower surface of the fixed scroll 250 to separate a discharge path of the refrigerant from the oil storage chamber V4. In addition, a through hole 276 may be formed in the discharge cover 270 so that an oil feeder 271 coupled to a sub-bearing portion 226*g*, which forms a second hearing portion and is submerged in the oil storage chamber V4 of the casing 210, of the rotary shaft 226 may pass through the through hole 276.

The second sidewall 255 may include a fixed scroll discharge hole (hereinafter, a "second discharge hole") 256*b* that passes through an inside of the second sidewall 255 in the axial direction and forms a refrigerant path with the first discharge hole 231*a*. The second discharge hole 256*b* may be formed to correspond to the first discharge hole 231*a*, an inlet of the second discharge hole 256*b* may communicate with the inner space of the discharging cover 270, and an outlet of the second discharge hole 256*b* may communicate with the inlet of the first discharge hole 231*a*.

The third space V3 may communicate with the second space V2 using the second discharge hole 256*b* and the first discharge hole 231*a* to guide a refrigerant, which is discharged from the compression chamber S1 to the inner space of the discharge cover 270, to the second space V2. In addition, the refrigerant suction pipe 218 may be installed or provided in the second sidewall 255 to communicate with a suction side of the compression chamber S1. The refrigerant suction pipe 218 may be spaced apart from the second discharge hole 256*b*.

The second bearing section 252 may protrude from a lower surface of the second end plate 254 toward the oil storage chamber V4. The second bearing section 262 may include the second bearing portion so that the sub-bearing portion 226*g* of the rotary shaft 226 may be inserted into and supported by the second bearing portion. A lower end of the second bearing section 252 may be bent toward a center of the shaft to support a lower end of the sub-bearing portion 226*g* of the rotary shaft 226 to form a thrust bearing surface.

The orbiting scroll 240 forming a second scroll may be installed or provided between the main frame 230 and the fixed scroll 250. More specifically, the orbiting scroll 240 may be coupled to the rotary shaft 226, to perform an orbiting movement and form two compression chambers S1, that is, a pair of compression chambers S1, between the orbiting scroll 240 and the fixed scroll 250.

The orbiting scroll 240 may include an orbiting scroll end plate thereinafter, a "third end plate") 245 having a substantially circular shape, the orbiting wrap 241 which protrudes from a lower surface of the third end plate 245 and is engaged with the fixed wrap 251, and a rosary shall coupler 242 provided at a center of the third end plate 245 and rotatably coupled to an eccentric portion 226*f* of the rotary shaft 226. In the orbiting scroll 240, an outer circumferential portion of the third end plate 245 may be located at an upper end of the second sidewall 255, and a lower end of the orbiting wrap 241 may be pressed against an upper surface of the second end plate 254 so that the orbiting scroll 240 may be supported by the fixed scroll 250.

An outer circumferential portion of the rotary shaft coupler 242 may be connected to the orbiting wrap 241 to form the compression chamber S1 with the fixed wrap 261 during a compression process. The fixed wrap 251 and the orbiting wrap 241 may be formed in an involute shape, but may also be formed in any of various shapes other than the involute shape. The term "involute shape" refers to a curved line corresponding to a trajectory drawn by an end of a thread when the thread wound around a base circle having an arbitrary radius is released.

The eccentric portion 226*f* of the rotary shaft 228 may be inserted into the rotary shaft coupler 242. The eccentric portion 226*f* inserted into the rotary shaft coupler 242 may overlap the orbiting wrap 241 or the fixed wrap 251 in a radial direction of the compressor.

The term "radial direction" may refer to a direction, that is, a lateral direction, perpendicular to an axial direction, that is, a vertical direction. More specifically, the radial direction may refer to a direction from an outside of the rotary shaft to an inside thereof.

As described above, when the eccentric portion 226*f* of the rotary shaft 228 passes through the third end plate 245 and overlaps the orbiting wrap 241 in the radial direction, a repulsive force and a compressive force of a refrigerant may be applied to a same plane based on the third end plate 245 to be partially canceled. In addition, the rotary shaft 226 may be coupled to the drive motor 220 and include the oil supply path 226*a* to guide the oil stored in the oil storage chamber V4 of the casing 210 upward. More specifically, an upper portion of the rotary shaft 226 may be press-fitted info and coupled to a center of the rotor 224, and a lower portion of the rotary shaft 226 may be coupled to the compression device 200 and supported in the radial direction by the compression device 200.

Accordingly, the rotary shaft 226 may transmit a rotational force of the drive motor 220 to the orbiting scroll 240 of the compression device 200. In addition, the orbiting scroll 240 eccentrically coupled to the rotary shaft 226 may perform an orbiting movement with respect to the fixed scroll 250 using the transmitted rotational force.

A main bearing portion 226*c* may be formed at a lower portion of the rotary shaft 226 to be inserted into the first bearing section 232*a* of the main frame 230 and supported in a radial direction by the first bearing section 232*a*. In addition, the sub-bearing portion 226*g* may be formed under the main hearing portion 226*c* to be inserted info the second bearing section 252 of the fixed scroll 250 and supported in the radial direction by the second bearing section 252. In addition, the eccentric portion 226*f* may be formed between the main bearing portion 226*c* and the sub-bearing portion 226*g* to be inserted into and coupled to the rotary shaft coupler 242 of the orbiting scroll 240.

The main bearing portion 226*c* and the sub-bearing portion 226*g* may be coaxially formed to have a same axial center, and the eccentric portion 226*f* may be eccentrically formed in the radial direction with respect to the main bearing portion 226*c* or the sub-bearing portion 226*g*. For example, the eccentric portion 226*f* may have an outer diameter smaller than an outer diameter of the main bearing portion 226*c* and larger than an outer diameter of the sob-bearing portion 226*g*. In this case, the rotary shaft 226 may have an advantage in that the rotary shaft 226 may pass through and be coupled to the bearing sections 232*a* and 252 and the rotary shaft coupler 242.

Conversely, the eccentric portion 226*f* may not be formed integrally with the rotary shaft 226 but may be formed using a separate bearing. In this case, even when the sub-bearing portion 226*g* is not formed to have an outer diameter which is smaller than an outer diameter of the eccentric portion 226*f*, the rotary shaft 226 may be inserted into and coupled to the bearing sections 232*a* and 252 and the rotary shaft coupler 242.

The oil supply path 226*a* for supplying the oil of the oil storage chamber V4 to circumferential surfaces of the bearing portions 226*c* and 226*g* and the eccentric portion 226*f* may be formed in the rotary shaft 226. Oil holes, for example, oil holes 228*a*, 228*d*, 228*e*, and 228*f* which pass from the oil supply path 226*a* to the outer circumferential surface thereof may be formed in the bearing portions 226*c* and 226*g* and the eccentric portions 226*f* of the rotary shaft 226. The oil holes will be described hereinafter.

The oil feeder 271 that pumps oil from the oil storage chamber V4 may be coupled to a lower end of the rotary shaft 226, that is, a lower end of the sub-bearing portion 226*g*. The oil feeder 271 may be formed with an oil supply pipe 273 inserted into and coupled to the oil supply path 226*a* of the rotary shaft 226, and an oil suction pump 274 inserted into the oil supply pipe 273 and configured to suction oil. The oil supply pipe 273 may be installed or provided to pass through the through hole 276 of the discharge cover 270 and be submerged in the oil storage chamber V4, and the oil suction pump 274 may function like a propeller.

Although not illustrated in the drawing, a trochoid pump (not shown) may be coupled to the sub-bearing portion 226*g* instead of the oil feeder 271 to forcibly pump the oil contained in the oil storage chamber V4. Further, although not illustrated in the drawing, the scroll compressor according to an embodiment may further include a first sealing member or seal (not shown) that seals a gap between an upper end of the main bearing portion 226*c* and an upper end of the main frame 230, and a second sealing member or seal (not shown) that seals a gap between a lower end of the sub-bearing portion 226*g* and a lower end of the fixed scroll 250. Leakage of oil to an outside of the compression device 200 along a bearing surface, that is, an outer circumferential surface of a hearing portion, may be prevented by the first and second sealing members or seals to realize a differential pressure structure for supplying oil and prevent backflow of a refrigerant.

A balance weight 227 that suppresses noise and vibration may be coupled to the rotor 224 or the rotary shaft 226. The balance weight 227 may be provided between the drive motor 220 and the compression device 200, that is, in the second space V2.

An operation process of the scroll compressor according to an embodiment will be described hereinafter.

When power is applied to the drive motor 220 and a rotational force is generated, the rotary shaft 226 coupled to the rotor 224 Of the drive motor 220 is rotated. Accordingly, the orbiting scroll 240 eccentrically coupled to the rotary shaft 226 may perform an orbiting movement with respect to the fixed scroll 250 and form the compression chamber S1 between the orbiting wrap 241 and the fixed wrap 251. The compression chamber S1 may be continuously formed in several steps such that a volume thereof gradually decreases toward a center thereof.

Then, a refrigerant supplied from outside of the casing 210 through the refrigerant suction pipe 218 may directly flow into the compression chamber S1. The refrigerant may be compressed while being moved toward, a discharge chamber of the compression chamber S1 by the orbiting movement of the orbiting scroll 240 to be discharged from the discharge chamber to the third space V3 through the discharge hole 253 of the fixed scroll 250. Next, a series of processes in which the compressed refrigerant discharged to the third space V3 is discharged to the inner space of the casing 210 through the second discharge hole 256*b*and the first discharge hole 231*a*, and is discharged to the outside of the casing 210 through the refrigerant discharge pipe 216 may be repeated.

When the scroll compressor is operated, oil stored in the oil storage chamber V4 may be pumped by the oil feeder 271 and guided upward through the oil supply path 226*a* included in the rotary shaft 226. The oil guided upward may be discharged through oil holes, for example, the oil holes, 228*a*, 228*d*, 228*e*, and 228*f*, passing from the oil supply path 228*a* to the outer circumferential surface thereof and supplied to a bearing surface, that is, the outer circumferential surface of the bearing portion.

Such a structure for supplying oil may be referred to as a centrifugation structure for supplying oil. Hereinafter, the centrifugation structure for supplying oil will be described.

Figure 2:
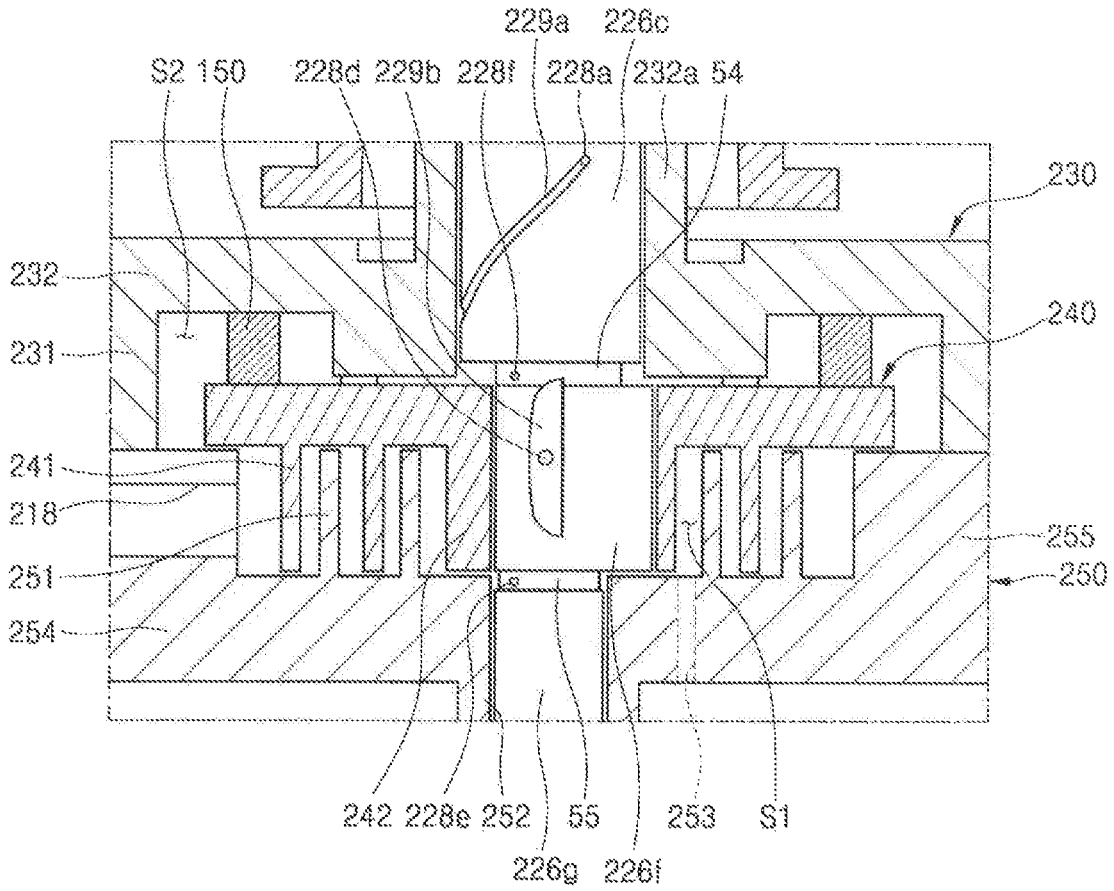
FIGS. 2 and 3 are schematic views of a structure for supplying oil of the scroll compressor of FIG. 1 according to an embodiment.
Figure 3:
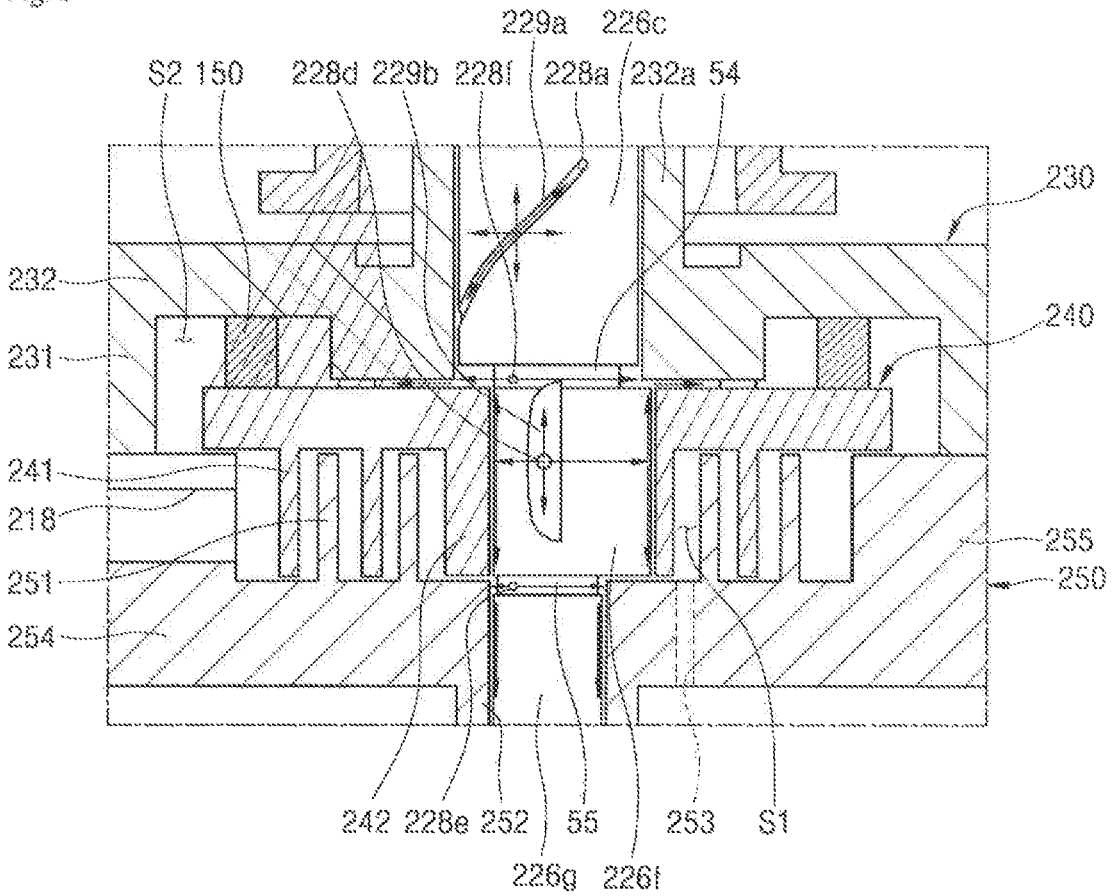

FIGS. 2 and 3 are schematic views of a structure for supplying oil of the scroll compressor of FIG. 1 according to an embodiment. One embodiment of the centrifugation structure for supplying oil is illustrated in FIGS. 2 and 3.

More specifically, the oil holes may include a first oil hole 228*a*, a second oil hole 228*d*, a third oil hole 228*e*, and a fourth oil hole 228*f*. The first oil hole 228*a* may pass through, an outer circumferential surface of the main bearing portion 228*c*. More specifically, the first oil hole 228*a* may pass from the oil supply path 226*a* to the outer circumferential surface of the main bearing portion 228*c*.

The first oil hole 228*a* may pass through an upper portion of the outer circumferential surface of the main bearing portion 226*c*, for example; however, embodiments are not limited thereto. That is, the first oil hole 228*a* may also pass through a lower portion of the outer circumferential surface of the main bearing portion 226*c*.

Also, unlike the drawing, the first oil hole 228*a* may include a plurality of holes. When the first oil hole 228*a* includes the plurality of holes, the plurality of holes may be formed in only the ripper or lower portion of the outer circumferential surface of the main bearing portion 226*c* or may be formed in each of the upper and lower portions of the outer circumferential surface of the main bearing portion 226*c*. However, in this embodiment, the first oil hole 228*a* including one hole is exemplified and described for the sake of convenience of description.

In addition, a first oil groove 229*a* obliquely or spirally formed and having one or a first end connected to the first oil hole 228*a* may be formed in the outer circumferential surface of the main bearing portion 226*c*. More specifically, as the first, end of the first oil groove 229*a* may be connected to the first oil hole 228*a*, some oil discharged from the first oil hole 228*a* may be efficiently supplied to the outer circumferential surface of the main bearing portion 226*c* along the first oil groove 229*a*. That is, some of the oil discharged from the first oil hole 228*a* may flow along the first oil groove 229*a* and be supplied to upper, lower, and lateral sides of the outer circumferential surface of the main bearing portion 226*c*. The remaining oil discharged from the first oil hole 228*a* may be directly supplied to the upper, lower, and lateral sides of the outer circumferential surface of the main bearing portion 226*c* around the first oil hole 228*a*.

The first oil groove 229*a* may be obliquely formed in a direction of rotation of the rotary shaft 226 or an opposite direction. That is, the first oil groove 229*a* may obliquely extend between the axial direction and the rotational direction (or the opposite direction of rotation) of the rotary shaft 226.

Unlike the drawing, the first oil groove 229*a* may include a plurality of grooves. For example, when the first oil groove 229*a* includes the plurality of grooves and the first oil hole 228*a* includes one hole, one or a first end of the grooves may be formed to be connected, to the first oil hole 228*a*. In addition, when the first oil groove 229*a* includes the plurality of grooves and the first oil hole 228*a* includes one hole, one or a first end of the grooves may be formed to be connected to the holes one to one. However, in this embodiment, the first oil groove 229*a* including one groove is exemplified and described for the sake of convenience of description.

The second oil hole 228*d* may pass through an outer circumferential surface of the eccentric portion 226*f*. More specifically, the second oil hole 228*d* may pass from the oil supply path 226*a* to the outer circumferential surface of the eccentric portion 228*f*.

In addition, the second oil hole 228*d* may pass through a central portion of the outer circumferential surface of the eccentric portion 226*f*, for an example; however, embodiments are not limited thereto. That is, the second oil hole 228*d* may also pass through an upper or lower portion of the outer circumferential surface of the eccentric portion 226*f*.

Unlike the drawing, the second oil hole 228*d* may also include a plurality of holes. When the second oil hole 228*d* includes the plurality of holes, the plurality of holes may be formed at only a central portion of the outer circumferential surface of the eccentric portion 226*f* or may be formed at the upper and lower portions of the outer circumferential surface of the eccentric portion 226*f*. However, in this embodiment, the second oil hole 228*d* including one hole will be described for the sake of convenience of description.

A second oil groove 229*b* may be formed in the outer circumferential surface of the eccentric portion 226*f* to be connected to the second oil hole 228*d* and extend perpendicularly therefrom. More specifically, as the second oil hole 228*d* is formed at the central portion of the second oil groove 229*b*, some oil discharged from the second oil hole 228*d* may be efficiently supplied to the outer circumferential surface of the eccentric portion 226*f* along the second oil groove 229*b*. That is, some of the oil discharged from the second oil hole 228*d* may flow along the second oil groove 229*b* and be supplied to upper, lower, and lateral sides of the outer circumferential surface of the eccentric portion 226*f*. The remaining oil discharged from the second oil hole 228*d* may be directly supplied to the upper, lower, and lateral sides of the outer circumferential surface of the eccentric portion 226*f* around the second oil hole 228*d*.

However, the second oil hole 228*d* may also be formed in an upper or lower portion of the second oil groove 229*b*. In addition, the second oil groove 229*b* may be linearly formed in a perpendicular direction, that is, a longitudinal or axial direction, as illustrated in the drawing, but may also be obliquely or spirally formed in the longitudinal direction in some cases.

Unlike the drawing, the second oil groove 229*b* may also include a plurality of grooves. For example, when the second oil groove 229*b*includes the plurality of grooves and the second oil hole 228*d* includes a plurality of holes, a hole may be formed in a central portion of each of the grooves. However, in this embodiment, the second oil groove 229*b* including one groove is exemplified and described for the sake of convenience of description.

The third oil hole 228*e* may be formed between the eccentric portion 226*f* and the sub-bearing portion 226*g*. More specifically, the third oil hole 228*e* may be formed in a second small diameter portion 55 by which the eccentric portion 226*f* and the sub-bearing portion 226*g* are spaced a predetermined distance from each other. That is, the third oil hole 228*e* may pass from the oil supply path 226*a* to an outer circumferential surface of the second small diameter portion 55.

The second small diameter portion 55 may be provided to secure processibility for forming the eccentric portion 226*f* and the sub-bearing portion 226*g* in, for example, a grinding process. In addition, the second small diameter portion 55 may also be provided to secure a damping space for continuously supplying oil guided upward through the rotary shaft 226.

Unlike the drawing, the third oil hole 226*e* may also include a plurality of holes. When the third oil hole 226*e* includes the plurality of holes, the holes may be formed to be spaced a predetermined distance from each other in the second small diameter portion 55. However, in this embodiment, the third oil hole 226*e* including one hole is exemplified and described for the sake of convenience of description.

The fourth oil hole 228*f* may be formed between the main bearing portion 226*c* and the eccentric portion 226*f*. More specifically, the fourth oil hole 228*f* may be formed in a first small diameter portion 54 by which the main bearing portion 226*c* and the eccentric portion 226*f* are spaced a predetermined distance from each other. That is, the fourth oil hole 228*f* may pass from the oil supply path 226*a* to an outer circumferential surface of the first small diameter portion 54.

The first small diameter portion 54 may be provided to secure processibility for forming the main bearing portion 226*c* and the eccentric portion 226*f* in, for example, a grinding process. In addition, the first small diameter portion 54 may also be provided to secure a damping space for continuously supplying the oil guided upward through the rotary shaft 226.

Unlike the drawing, the fourth oil hole 228*f* may also include a plurality of holes. When the fourth oil hole 228*f* includes the plurality of holes, the holes may be formed to be spaced a predetermined distance from each other in the first small diameter portion 54. However, in this embodiment the fourth oil hole 228*f* including one hole is exemplified and described for the sake of convenience of description.

As a result, oil guided upward through the oil supply path 226*a* may be discharged through the first oil hole 228*a* and supplied to the entire outer circumferential surface of the main bearing portion 226*c*, as illustrated in FIG. 3. The oil guided, upward through the oil supply path 226*a* may be discharged through the second oil hole 228*d*, supplied to the entire outer circumferential surface of the eccentric portion 226*f*, discharged through the third oil hole 228*e*, and supplied to an outer circumferential surface of the sub-bearing portion 226*g* or supplied between the orbiting scroll 240 and the fixed scroll 250. The oil guided upward through the oil supply path 226*a* may also be discharged through the fourth oil hole 228*f* and supplied to an upper surface of the orbiting scroll 240.

An additional oil hole (not shown) may pass from the oil supply path 226*a* to the outer circumferential surface of the sub-bearing portion 226*g*. Oil discharged through the corresponding additional oil hole may also be supplied to the entire outer circumferential surface of the sub-hearing portion 226*g*.

As described above, the oil stored in the oil storage chamber V4 may be guided, upward through the rotary shaft 226 and easily supplied to the bearing surface through, the plurality of oil holes 228*a*, 228*d*, 228*e*, and 228*f* so that wear of the bearing surface may be prevented. The oil discharged through the plurality of oil holes 228*a*, 228*d*, 228*e*, and 228*f* may form an oil film between the fixed scroll 250 and the orbiting scroll 240 to maintain a hermetic state there between. The oil discharged through the plurality of oil holes 228*a*, 228*d*, 228*e*, and 228*f* may also absorb frictional heat generated by a friction portion to dissipate the heat from the high temperature compression device 200.

Hereinafter, another embodiment of a centrifugation structure for supplying oil will be described with reference to FIGS. 4 and 5.

Figure 4:
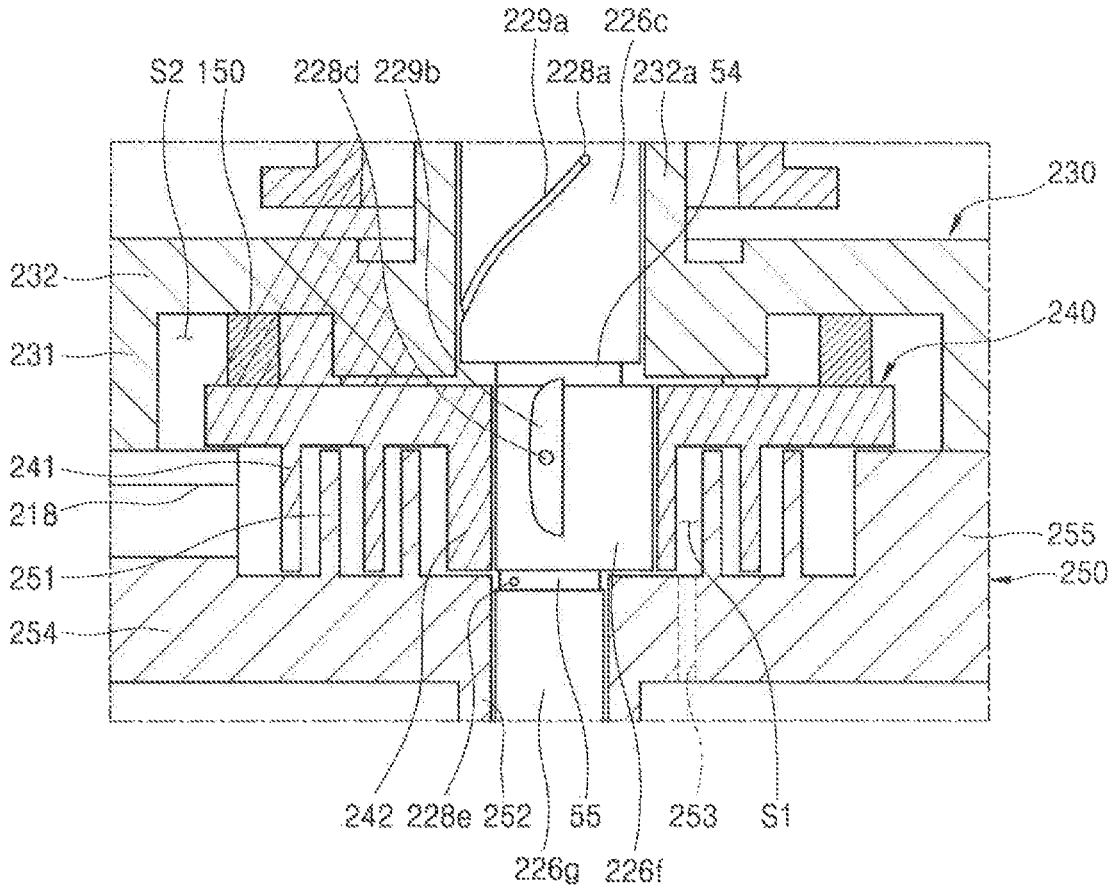
FIGS. 4 and 5 are schematic views of the structure for supplying oil of the scroll compressor of FIG. 1 according to another embodiment.
Figure 5:
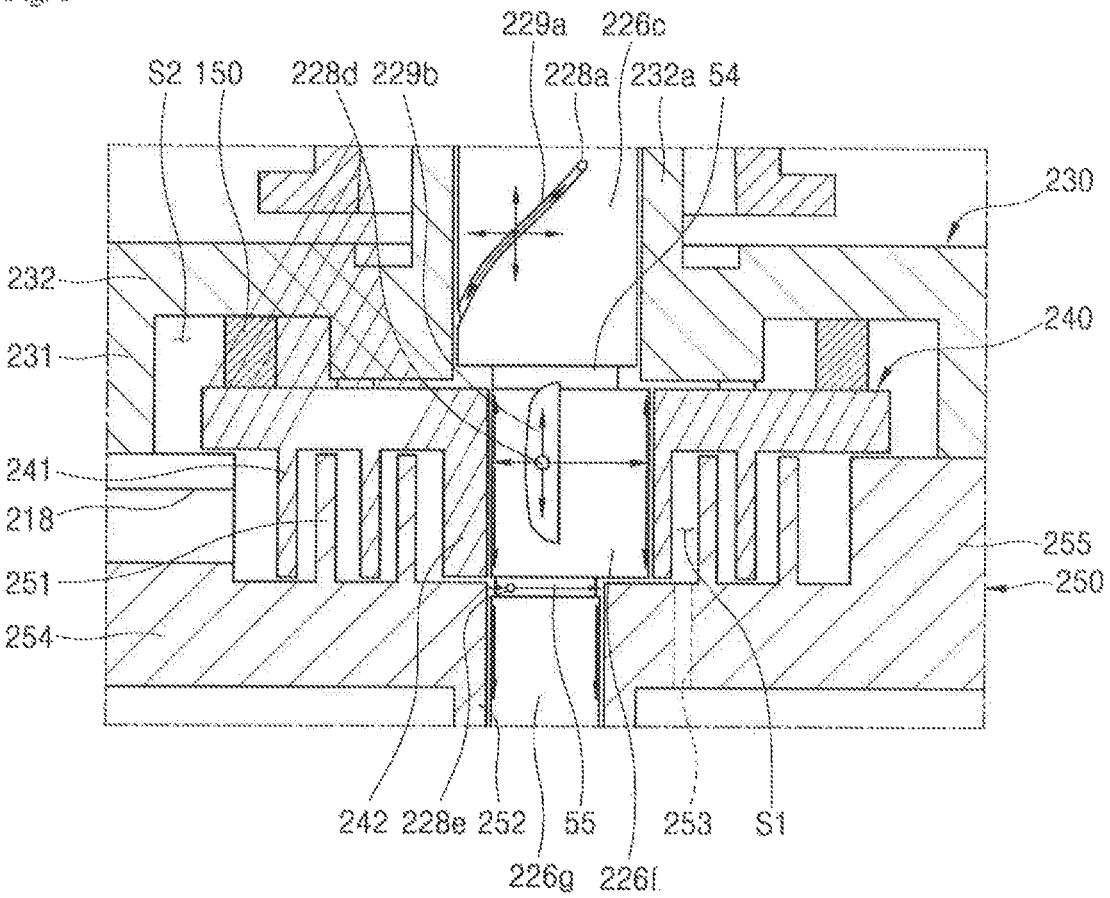

FIGS. 4 and 5 are schematic views of a structure for supplying oil of the scroll compressor of FIG. 1 according to another embodiment. Structural differences between the centrifugation structure for supplying oil illustrated in FIGS. 4 and 5 and the centrifugation structure for supplying oil illustrated in FIGS. 2 and 3 will be described, and repetitive disclosure has been omitted.

Oil holes may include first oil hole 228*a*, second all hole 228*d*, and third oil hole 228*e*. That is, unlike FIG. 2, the oil holes of FIG. 4 may not include the fourth oil hole 228*f* of FIG. 2, formed between main bearing portion 226*c* and eccentric portion 226*f*.

However, the first oil hole 228*a* and the second oil hole 228*d* may share the role of the fourth oil hole 228*f* of FIG. 2. More specifically, as described above, the fourth oil hole 228*f* of FIG. 2 may serve to guide the oil guided upward through the oil supply path 226*a* (see FIG. 1) to be supplied to the upper surface of the orbiting scroll 240.

That is, the fourth oil hole 228*f* of FIG. 2 may serve to guide oil to be efficiently supplied to the upper surface of an orbiting scroll 240. However, as there is no fourth oil hole in FIG. 4, some of the oil discharged through the first oil hole 228*a* and supplied to the outer circumferential surface of the main bearing portion 226*c* along first oil groove 229*a* may be supplied to the upper surface of orbiting scroll 240. In addition, some of oil discharged through the second oil hole 228*d* and supplied to the outer circumferential surface of eccentric portion 226*f* along second oil groove 229*b* m be supplied to the upper portion of the orbiting scroll 240. Accordingly, the first oil hole 228*a* and the second oil hole 228*d* may share the role of the fourth oil hole to indirectly perform the role.

As described above, the centrifugation structure for supplying oil of FIG. 4 may include one less oil hole than the centrifugation structure for supplying oil of FIG. 2. Accordingly, the centrifugation structure for supplying oil of FIG. 4 has a characteristic in that manufacturing costs and time are decreased in comparison with the centrifugation structure for supplying oil of FIG. 2. However, as oil is easily supplied to a bearing surface through the first to third oil holes 228*a*, 228*d*, and 228*e*, the centrifugation structure for supplying oil of FIG. 4 may have the same effect as that of the centrifugation structure for supplying oil of FIG. 2, that is, reduction of wear, maintenance of the hermetic state, and dissipation of heat, for example.

As described above, in the scroll compressor according to embodiments, as the oil stored in the oil storage chamber V4 may be easily supplied to the bearing surface through the centrifugation structure for supplying oil based on the rotary shaft 226, wear of the bearing portion may be prevented. In addition, as the wear of the bearing portion may be prevented, reliability of the bearing portion may be secured.

In addition, in the scroll compressor according to embodiments, an oil film may be formed between the fixed scroll 250 and the orbiting scroll 240 by the oil in the oil storage chamber V4 being supplied upward using the centrifugation structure for supplying oil, hermetic state may be maintained, and frictional heat generated by the friction portion may also be absorbed to dissipate the heat from the high temperature compression device 200.

As described above, in a scroll compressor according to embodiments, as oil stored in an oil storage chamber is easily supplied to a bearing surface using a centrifugation structure for supplying oil using a rotary shaft, wear of the bearing surface may be prevented. In addition, as the wear of the bearing surface may fee prevented, reliability of the bearing portion may be secured.

Embodiments disclosed herein are directed to a scroll compressor capable of smoothly supplying oil stored in an oil storage chamber to a bearing surface through a centrifugation structure for supplying oil using a rotary shaft.

Objects of the embodiments are not limited to the described objects, and other objects and advantages of the embodiments may be understood by the following descriptions, and clearly understood by the embodiments described. In addition, it may be seen that the objects and the advantages of the embodiments may be made using elements and combinations thereof described in the appended claims.

A scroll compressor according to embodiments disclosed herein may include an oil supply path configured to guide oil stored in an oil storage chamber of a casing upward, and an oil hole configured to pass from the oil supply path to an outer circumferential surface of a rotary shaft so that the oil may be easily supplied to a bearing surface.

This application relates to U.S. application Ser. No. 15/830,135, U.S. application Ser. No. 15/830,161, U.S. application Ser. No. 15/830,184, U.S. application Ser. No. 15/830,222, and U.S. application Ser. No. 15/830,248, all filed on Dec. 4, 2017, which are hereby incorporated by reference in their entirety. Further, one of ordinary skill in the art will recognize that features disclosed in these above-noted applications may be combined in any combination with features disclosed herein.

While embodiments have been described for those skilled in the art, it should be understood that the embodiments may be replaced, modified, and changed without departing from the technical spirit, and thus, the embodiments are not limited to the above-described embodiments and the accompanying drawings.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component pads and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing in which oil is stored in an oil storage chamber formed at a lower portion of the casing;

a drive motor provided in an inner space of the casing;

a rotary shaft coupled to the drive motor and including an oil supply path configured to guide the oil stored in the oil storage chamber upward and at least one oil hole that passes from the oil supply path to an outer circumferential surface of the rotary shaft;

a main frame coupled to the rotary shaft and provided under the drive motor;

a fixed scroll coupled to the rotary shaft and provided under the main frame; and an orbiting scroll provided between the main frame and the fixed scroll and into which the rotary shaft is inserted and to which the rotary shaft is eccentrically coupled, the orbiting scroll being engaged with the fixed scroll to perform an orbiting movement to form a compression chamber with the fixed scroll, wherein the oil guided upward through the oil supply path is discharged through the at least one oil hole and supplied to the outer circumferential surface of the rotary shaft, wherein the rotary shaft further includes:

a main bearing portion configured to be inserted into the main frame and supported in a radial direction by the main frame;

an eccentric portion configured to be inserted into and eccentrically coupled to the orbiting scroll; and a sub-bearing portion configured to be inserted into the fixed scroll and supported in the radial direction by the fixed scroll, wherein the at least one oil hole includes:

a first oil hole that passes from the oil supply path to an outer circumferential surface of the main bearing portion;

a second oil hole formed that passes from the oil supply path to an outer circumferential surface of the eccentric portion;

a third oil hole that extends between the eccentric portion and the sub-bearing portion; and a fourth oil hole that extends between the main bearing portion and the eccentric portion, wherein the oil guided upward through the oil supply path is discharged through the first oil hole and supplied to the outer circumferential surface of the main bearing portion, discharged through the second oil hole and supplied to the outer circumferential surface of the eccentric portion, discharged through the third oil hole and supplied between the orbiting scroll and the fixed scroll, and discharged through the fourth oil hole and supplied to an upper surface of the orbiting scroll.

2. The scroll compressor of claim 1, further comprising:

a first oil groove, which is obliquely or spirally formed and has a first end connected to the first oil hole, formed in the outer circumferential surface of the main bearing portion, wherein the first oil groove is inclined in a direction of rotation of the rotary shaft or an opposite direction.

3. The scroll compressor of claim 2, further comprising:

a second oil groove formed in the outer circumferential surface of the eccentric portion to be connected to the second oil hole and extending in a vertical direction.

4. The scroll compressor of claim 1, further comprising:

an oil feeder coupled to a lower end of the sub-bearing portion to pump the oil stored in the oil storage chamber, wherein the oil feeder includes:

an oil supply pipe inserted into and coupled to the oil supply path of the rotary shaft; and an oil suction pump inserted into the oil supply pipe and configured to suction oil.

5. A scroll compressor, comprising:

a casing in which oil is stored in an oil storage chamber formed at a lower portion of the casing;

a drive motor including a stator fixed inside of the casing and a rotor rotatably provided inside of the stator;

a rotary shaft coupled to the rotor and configured to rotate with the rotor, the rotary shaft including an oil supply path configured to guide the oil stored in the oil storage chamber upward and at least one oil hole configured to pass from the oil supply path to an outer circumferential surface of the rotary shaft; and a compression device having a main frame provided under the drive motor, a fixed scroll provided under the main frame, and an orbiting scroll provided between the fixed scroll and the main frame and engaged with the fixed scroll to form a compression chamber, wherein the rotary shaft passes through the compression chamber, and wherein the oil guided upward through the oil supply path is discharged through the at least one oil hole and supplied to the outer circumferential surface of the rotary shaft, wherein the rotary shaft further includes:

a main bearing portion configured to be inserted into the main frame and supported in a radial direction by the main frame;

an eccentric portion configured to be inserted into and eccentrically coupled to the orbiting scroll; and a sub-bearing portion configured to be inserted into the fixed scroll and supported in the radial direction by the fixed scroll, wherein the at least one oil hole includes:

a first oil hole that passes from the oil supply path to an outer circumferential surface of the main bearing portion and connected to a first oil groove which is formed in the outer circumferential surface of the main bearing portion;

a second oil hole that passes from the oil supply path to an outer circumferential surface of the eccentric portion and connected to a second oil groove which is formed in the outer circumferential surface of the eccentric portion;

a third oil hole that extends between the eccentric portion and the sub-bearing portion; and a fourth oil hole that extends between the main bearing portion and the eccentric portion, wherein the oil guided upward through the oil supply path is discharged through the first oil hole and supplied to the outer circumferential surface of the main bearing portion along the first oil groove, discharged through the second oil hole and supplied to the outer circumferential surface of the eccentric portion along the second oil groove, discharged through the third oil hole and supplied between the orbiting scroll and the fixed scroll, and discharged through the fourth oil hole and supplied to an upper surface of the orbiting scroll.

6. The scroll compressor of claim 5, wherein the first oil groove is obliquely or spirally formed in the outer circumferential surface of the main bearing portion and is inclined in a direction of rotation of the rotary shaft or an opposite direction, and wherein the second oil groove is formed in the outer circumferential surface of the eccentric portion and extends in a vertical direction.

* * * * *